US005737778A

United States Patent [19]

Black

[11] Patent Number: 5,737,778

[45] Date of Patent: Apr. 14, 1998

[54] TOILET SEAT ACTUATOR

[76] Inventor: Clint Patrick Black, c/o Charles Sussman, Sussman & Associates 1222 16th Ave. South, Third Floor, Nashville, Tenn. 37212

[21] Appl. No.: 622,813

[22] Filed: Mar. 27, 1996

[51] Int. Cl.[6] ..... A47K 13/10

[52] U.S. Cl. ..... 4/246.1; 4/405

[58] Field of Search ..... 4/246.1, 405

[56] References Cited

U.S. PATENT DOCUMENTS

| | | | |
|---|---|---|---|
| 172,891 | 2/1876 | Poole | 294/26 X |
| D. 219,111 | 11/1970 | Moen | 294/26 X |
| 1,176,781 | 3/1916 | Schoon | 294/26 |
| 1,482,056 | 1/1924 | Watkins | 294/26 |
| 2,877,045 | 3/1959 | Payne | 294/26 |
| 4,835,799 | 6/1989 | Beelart, Jr. | 4/246.1 |
| 4,856,140 | 8/1989 | Visco et al. | 4/405 X |

FOREIGN PATENT DOCUMENTS

| | | | |
|---|---|---|---|
| 0176266 | 10/1906 | Germany | 4/246.1 |

*Primary Examiner*—Robert M. Fetsuga
*Attorney, Agent, or Firm*—Abelman, Frayne & Schwab

[57] ABSTRACT

A toilet seat lifter is provided for the manually lifting and lowering of a toilet seat without requiring the user to actually touch the toilet seat. The toilet seat lifter is not secured to the toilet seat. It is in the form of a stick-like member having a manually graspable portion at one end thereof, and an actuating section at the opposite end. The actuating section is in the form of a bifurcated fish tail. To provide for further hygienetic utilization of the toilet facility, single use disposal sheath-like members are dispensed, which may be used to both cover the handle of the toilet seat lifter and manually operable toilet flush handle.

1 Claim, 1 Drawing Sheet

TOILET SEAT ACTUATOR

FIELD OF THE INVENTION

This relates to a toilet seat actuator which permits the user to raise and lower the toilet seat without necessitating manual touching. This provides increased sanitation, particularly at public toilet facilities. Advantageously, it does not require modification of the toilet seat, thereby maximizing the universitality of its utilization.

DESCRIPTION OF THE PRIOR ART

Users of toilet commodes, particularly at public locations, are oftentimes concerned about the possible spreading of disease by touching the toilet seat, which is obviously necessary in order to raise and lower same. The desire to avoid such manual touching has been previously addressed with only a limited degree of acceptability. Several previously proposed solutions have required an additional element to be physically attached to the toilet seat. Typical of such prior toilet seat lifters are U.S. Pat. Nos. 1,999,555, 3,783,455, 4,742,582 and 5,027,472.

In addition to the need to modify the toilet seat, and its attendant costs and complexities, such lifters, due to their continual proximity to the toilet seat, can tend to become soiled over an extended period of time. Hence, they can subject the user to the same sanitary concerns of physically grasping the toilet seat itself.

U.S. Pat. No. 2,758,315 is directed to a similar type of lifter for the cover portion of the toilet seat assembly, which disadvantageously also requires physical attachment to the cover.

U.S. Pat. No. 5,058,215 is directed to a toilet seat lifter which is intended to be connected to the underside of the toilet seat by double coated adhesive tape. Due to its continued close proximity to the toilet seat, such a lifter can tend to become soiled over a period of time. Further, the adhesive securement might weaken, causing disengagement of the lifter, rendering it useless, and thereby again necessitating manual touching of the toilet seat.

U.S. Pat. No. 4,979,238 discloses a combination toilet seat lifter and flusher in which the toilet seat must be inserted in a narrow opening between an "L-shaped" round tube and the supporting holder. This would require a certain amount of dexterity, and limited versatility, since the unit would have to be customized in accordance with the thickness of the toilet seat.

U.S. Pat. No. 4,835,799 is directed to a rather complex clamping member having jaw members which must engage the toilet seat.

Hence, the myriad of prior proposals for avoiding the manual grasping of the toilet seat have demonstrated several disadvantages resulting in their lack of acceptability.

SUMMARY OF INVENTION

The present invention provides a very inexpensive and simple type device, having substantial universitality of application, ease of use, and a high degree of sanitation. More specifically, a separate, toilet seat lifter is mounted to a stick-like member which is to be provided in proximity to the toilet, as by hanging on the wall. That is, it is not physically attached to the toilet seat. The lifter has an elongated handle, with a manually graspable member at one end. The other end includes a toilet seat engageable member which is in the general form of a bifurcated fish tail. It includes a central section secured to the handle, and a pair of freely extending actuating sections flaring outward of the central section. The extending sections are defined by opposed concave boundaries of greatest separation at the central section and smoothly tapering to, and meeting at, a juncture at their free end extremes. When grasped by the user, the bifurcated end can be easily placed beneath toilet seat, and then moved upward to raise the seat. Conversely, when it is desired to lower the seat, the seat is placed within the central region of the bifurcated sections.

To provide for a further degree of sanitation, a dispenser for disposable sheath-like covers may also be provided at the commode unit. When it is desired to use the lifter, the user removes one of the sheaths from the dispenser, and places same about the manually graspable end of the toilet seat lifter. This avoids the need to touch a lifter which has been previously held by another individual. After the lifter is used and the sheath is removed from the manually graspable end of the toilet seat lifter, it may preferably also then be placed over the manually operable flush handle of the toilet to thereby avoid the need to manually touch same.

Accordingly, it is the primary object of the present invention to provide a toilet commode unit of increased sanitation.

A further object of the present invention is to provide such a toilet commode unit which includes a toilet seat lifter of extreme simplicity and universitality, which does not require physical securement to the toilet seat.

Another object of the present invention is to provide such a commode unit in which the toilet seat lifter comprises an elongated handle having a manually graspable member at one end, and a bifurcated actuating member at its opposite end.

Yet a further object of the present invention is to provide such a commode assembly in which the bifurcated end of the toilet seat lifter is in the general shape of a fish tail.

Yet another object of the present invention is to provide such a commode assembly, which further includes individually dispensable sheaths for both covering the manually graspable member of the toilet seat lifter, and the toilet flush handle.

These, as well as other objects of the present invention will become apparent upon a consideration of the following description and drawings.

BRIEF DESCRIPTIONS OF DRAWINGS

DETAILED DESCRIPTION

Figure 1:
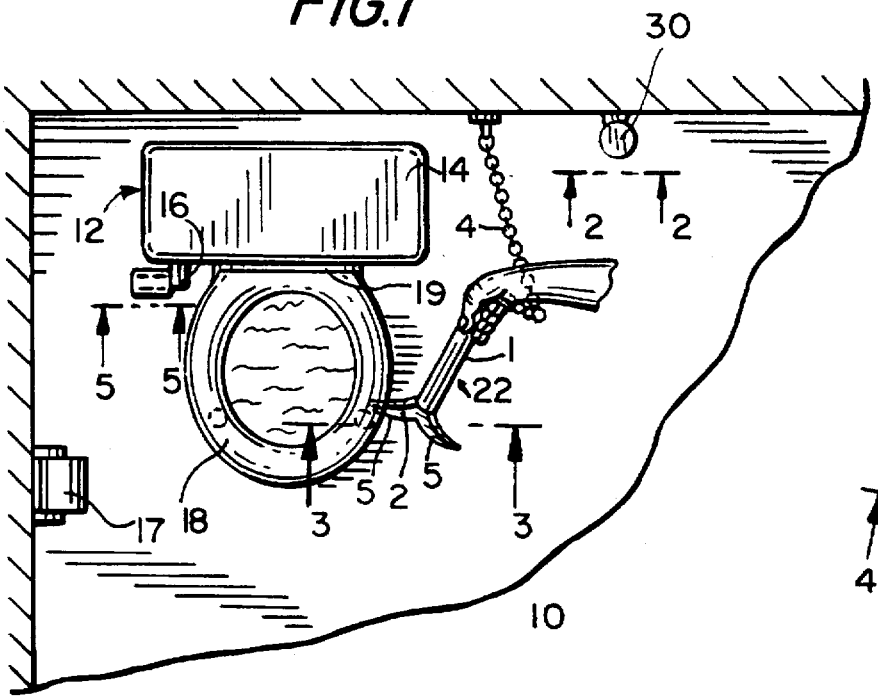
FIG. 1 is a top view of the commode unit which incorporates the components of the present invention.
Figure 2:
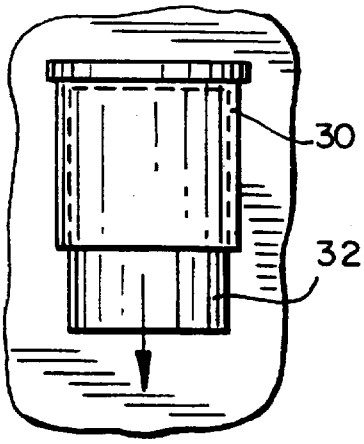
FIG. 2 is a front view of the sheath dispenser, as shown in FIG. 1, and looking in the direction of the arrows 2—2.

The toilet commode area generally shown as 10 includes the conventional type of toilet assembly 12 including water tank 14, manually operable flush handler 16, and toilet seat 18. Toilet seat 18 is hinged at end 19 to sit on toilet fixture 20 in the conventional manner. As it is well known, it is oftentimes necessary to raise and lower the toilet seat 18 with respect to toilet fixture 20. In accordance with the present invention, such movement of the toilet seat 18 is accomplished without necessitating the user actually touching toilet seat 18.

A toilet seat lifter, generally shown as 22 is provided. The toilet seat lifter includes an elongated stick-like member 1. At one end thereof, a manually graspable end 3 is provided. This may simply be the free end of stick-like member 1, or may include a gripper element (not shown) much like a bicycle handle bar grip. In accordance with the present invention, the opposite end of the toilet seat lifter includes the toilet seat engageable member 2 which is in the general shape of bifurcated fish tail. This member, which is preferably formed of plastic or rubber is appropriately secured to the end of stick-like member 1, as by adhesive or a dowel end (not shown).

The toilet seat engageable member 2 includes a pair of freely extending actuating sections 5 which flare outward of the central section 6. The extending sections 5 are defined by opposed concave boundaries 7, having their greatest separation at the central section 6 and smoothly tapering to and meeting at a juncture 8. The central meeting of the outer concave boundaries is shown as 9 in FIG. 3.

The toilet seat lifter 22 will preferably be attached at the toilet assembly 10 by a chain 4 of sufficient length so that the toilet seat lifter 22 may be manually grasped and readily moved into engagement with a toilet seat 18 for the lifting and lowering of same.

Figure 3:
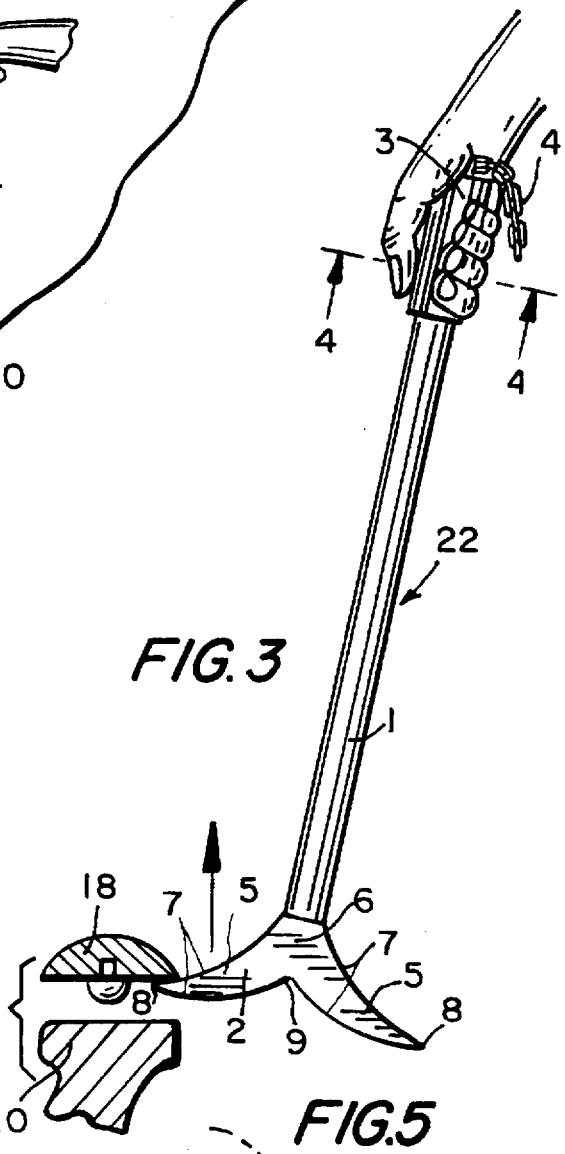
FIG. 3 is a front elevation view showing the manner in which the toilet seat lifter is utilized to raise the toilet seat.
Figure 4:
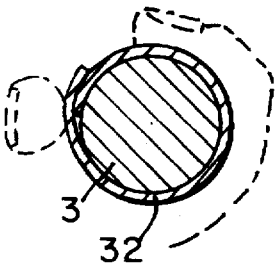
FIG. 4 is a sectional view along the line 4—4 of FIG. 3, and looking in the direction of the arrows, showing the manner in which the toilet lifter is manually grasped.
Figure 5:
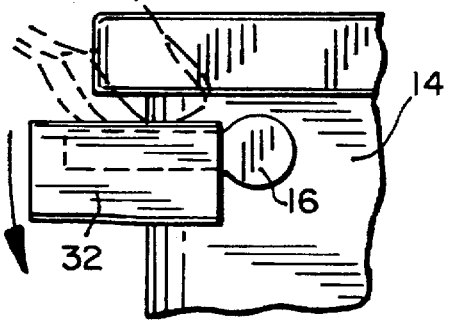
FIG. 5 is a front elevational view looking in the direction of arrows 5—5 of FIG. 1, and showing the manner in which the sheath member which is placed around the toilet seat lifter may also be utilized during toilet flushing.

In addition to the toilet seat lifter 22, the commode unit may preferably also include toilet tissue 17 and a disposable sheath dispenser 30 where individual cup-like paper sheaths 32 are successively dispensed much like a cup dispenser.

Where the dispenser 30 is included as part of the commode unit, an individual sheath 32 is first dispensed, and placed around the manually graspable end 3 of the toilet seat lifter, as shown in FIGS. 3 and 4. The actuating extension 2 is then inserted under the toilet seat 18 as shown in FIG. 5. The user will then move the toilet seat lifter 22 upward to pivot toilet seat 18 about hinge end 19 to the upward position.

When it is desired to lower the toilet seat the outer juncture 9 will be manually placed against the edge of the toilet seat 18, with the assembly pivoted downward.

It should be readily appreciated that when the toilet seat lifter 22 is not in use, it will be displaced from immediate proximity to the toilet seat 18, thereby preventing it from getting soiled during toilet usage.

Where the disposable sheath 32 is provided for individual usage of the toilet seat lifter, that sheath 32 may also be used to cover the manually flushable handle 16, as shown in FIG. 5 so as to provide for an increased hygienetic environment.

Accordingly, it should be understood that although the present invention has been described in conjunction with a specific embodiment, modifications and additions may be made thereto without departing from the scope of the present invention as defined in the appended claims.

What is claimed is:

1. A commode unit including:

a toilet having a hinged toilet seat moveable between down and up positions;

a portable toilet seat lifter independent of said toilet seat, adapted to be manually grasped and moved into engagement with said toilet seat for lifting said toilet seat between its down and up positions without manual touching of the toilet seat;

said toilet lifter comprising:

an elongated handle having opposed first and second ends;

a manually graspable member at said first end;

a toilet seat engageable member at said second end in the form of a bifurcated fish tail;

said toilet seat engageable member including a central section secured to the second end of said handle, and a pair of symmetric freely extending actuating sections flaring outward of said central section, each of said actuating sections defined by first upper and second lower opposed concave surfaces of greatest separation at said central section each of said first and second concave surfaces continually and gradually tapering towards each other in a generally downward direction, such that the width of each of said actuating sections continually narrows to provide a smooth transition between its central section and free end extreme, with said first and second concave surfaces of each of said actuating sections smoothly tapering to a lowermost position whereat they meet at first and second junctures at their respective free end extremes, said first and second junctures disposed in a plane generally perpendicular to the axis of said elongated handle;

the second concave surfaces of said pair of actuating sections meeting at an outer juncture at said central section, said outer juncture being indented and adapted to engage the edge of a raised toilet seat for lowering the toilet seat;

said elongated handle, manually graspable member and toilet seat engageable member being fixedly and permanently secured together to provide a unitary assembly; and storage means for keeping said toilet seat lifter in proximity to said toilet.

* * * * *